US005309630A

United States Patent [19]

Brunker et al.

[11] Patent Number: 5,309,630

[45] Date of Patent: May 10, 1994

[54] IMPEDANCE AND INDUCTANCE CONTROL IN ELECTRICAL CONNECTORS

[75] Inventors: David L. Brunker, Naperville; Frank A. Harwath, Downers Grove, both of Ill.

[73] Assignee: Molex Incorporated, Lisle, Ill.

[21] Appl. No.: 34,201

[22] Filed: Mar. 15, 1993

Related U.S. Application Data

[63] Continuation of Ser. No. 856,593, Mar. 24, 1992, abandoned, which is a continuation-in-part of Ser. No. 852,441, Mar. 16, 1992, Pat. No. 5,203,725.

[51] Int. Cl.[5] ..... H01R 9/00

[52] U.S. Cl. ..... 29/842; 29/874; 439/751

[58] Field of Search ..... 439/78, 79, 62, 65, 439/629-637, 607, 608, 55, 751; 29/842, 874, 875, 876, 884

[56] References Cited

U.S. PATENT DOCUMENTS

| | | | |
|---|---|---|---|
| 3,196,377 | 7/1965 | Minich | 439/60 |
| 3,470,522 | 9/1969 | Lawrence | 439/55 |
| 3,539,976 | 11/1970 | Reynolds | 339/177 |
| 3,573,704 | 4/1971 | Tarver | 339/14 |
| 4,461,522 | 7/1984 | Bakermans et al. | 439/636 |
| 4,552,420 | 11/1985 | Eigenbrode | 339/14 R |
| 4,707,039 | 11/1987 | Whipple | 439/75 |
| 4,878,849 | 11/1989 | Talwar et al. | 29/842 |
| 4,886,474 | 12/1989 | Drogo | 439/856 |
| 4,957,451 | 9/1990 | Nadin | 29/874 |
| 4,996,766 | 3/1991 | Piorunneck et al. | 29/842 |
| 5,026,292 | 6/1991 | Pickles et al. | 439/636 |
| 5,071,371 | 12/1991 | Harwath et al. | 439/637 |
| 5,077,893 | 1/1992 | Mosquera et al. | 29/874 |

*Primary Examiner*—David L. Pirlot
*Attorney, Agent, or Firm*—Charles S. Cohen

[57] ABSTRACT

A method and structure of an electrical connector is provided for tuning the impedance of the connector according to a given impedance of an electrical circuit in which the connector is interconnected. The connector includes a dielectric housing having a receptacle for receiving a complementary mating connector. A plurality of terminals are mounted on the housing. The terminals include body portions located in the housing and contact portions located at the receptacle for engaging appropriate terminals of the mating connector when inserted into the receptacle. The areas of the body portions of the terminals are selectively varied to vary the capacitance of the terminals and, therefore, the impedance of the connector to match the given impedance of the electrical circuit. When the connector is used for mounting to a printed circuit board, ground terminals have at least two feet for engaging a respective single ground trace of a common ground circuit on the printed circuit board for reducing the inductance between a particular ground terminal and its respective circuit trace.

15 Claims, 2 Drawing Sheets

IMPEDANCE AND INDUCTANCE CONTROL IN ELECTRICAL CONNECTORS

RELATED APPLICATION

This is a continuation of copending application Ser. No. 07/856,593, filed on Mar. 24, 1992, now abandoned, which is a continuation-in-part of application Ser. No. 07/852,441, filed on Mar. 16, 1992, U.S. Pat. No. 5,203,725.

FIELD OF THE INVENTION

This invention generally relates to the art of electrical connectors and, particularly, to methods and structure for controlling the impedance and the inductance in electrical connectors.

BACKGROUND OF THE INVENTION

In today's high speed electronic equipment, it is desirable that all components of an interconnection path be optimized for signal transmission characteristics, otherwise the integrity of the system will be impaired or degraded. Such characteristics include risetime degradation or system bandwidth, crosstalk, impedance control and propagation delay. Ideally, an electrical connector would have little or no affect on the interconnection system regarding these characteristics. An ideal connector would be "transparent". In other words, the system would function as if circuitry ran through the interconnection and there would be no affect on the system whatsoever. However, such an ideal connector is impractical or impossible, and continuous efforts are made to develop electrical connectors which have as little affect on the system as possible.

Impedance and inductance control are concerns in designing an ideal connector. This is particularly true in electrical connectors for high speed electronic equipment, i.e. involving high frequencies. An example of such connectors is the popular type of electrical connector commonly called an "edge card" connector. An edge card connector is provided for receiving a printed circuit board having a mating edge and a plurality of contact pads adjacent the edge. Such edge connectors have an elongated housing defining an elongated receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating "edge" board commonly is called the "daughter" board, and the board to which the connector is mounted is called the "mother" board.

This invention is directed to a method and structure for tuning the impedance of an electrical connector, such as an edge connector, for interconnection in an electrical circuit having a given impedance and tuning the connector to substantially match that impedance. The invention also is directed to providing terminals for printed circuit board mounted connectors which reduce the inductance of the connectors.

SUMMARY OF THE INVENTION

An object, therefore, of the invention is to provide a method and structure for tuning the impedance of an electrical connector adapted for interconnection in an electrical circuit having a given impedance.

Another object of the invention is to provide improved terminals for reducing the inductance of an electrical connector, particularly a connector mounted to a printed circuit board.

In the exemplary embodiment of the invention, generally, the connector includes a dielectric housing for mounting a plurality of terminals, the housing having a receptacle for receiving a complementary mating connector. Specifically, the invention is illustrated in an edge connector having a slot for receiving the mating edge of a printed circuit board.

The invention contemplates a method and structure of providing the terminals with body portions located in the housing and contact portions located at the receptacle or slot for engaging appropriate terminals of the mating connector or printed circuit board when inserted into the receptacle or slot. The area of the body portions of the terminals is selectively varied to selectively vary the capacitance of the terminals and, therefore, the impedance of the connector to match the given impedance of the electrical circuit.

The area of the body portions of the terminals may be varied by varying the overall size of the body portions. The body portions of the terminals may be provided of constant widths mountable in uniformly sized recesses in the housing, and the area of the body portions may be varied by varying the lengths thereof. Further, the body portions of the terminals may be provided of a uniform overall size mountable in uniformly sized recesses in the housing, and the area of the body portions may be varied by forming openings therein.

In the illustrated embodiment of the invention, i.e. in an edge connector, the body portions of the terminals are provided as mounting barbs press fit into recesses in the housing for securing the terminals in the housing. The terminals are provided with base portions, the contact portions and the mounting barbs projecting from the base portions.

The invention also contemplates an electrical connector for mounting on a printed circuit board having a common ground circuit and a plurality of circuit traces forming portions of the common ground circuit. The connector has a plurality of signal terminals and a plurality of ground terminals mounted in the housing. At least one of the ground terminals has at least two grounding feet for engaging a respective one of the circuit traces of the common ground circuit to establish a multiple-point contact therewith.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
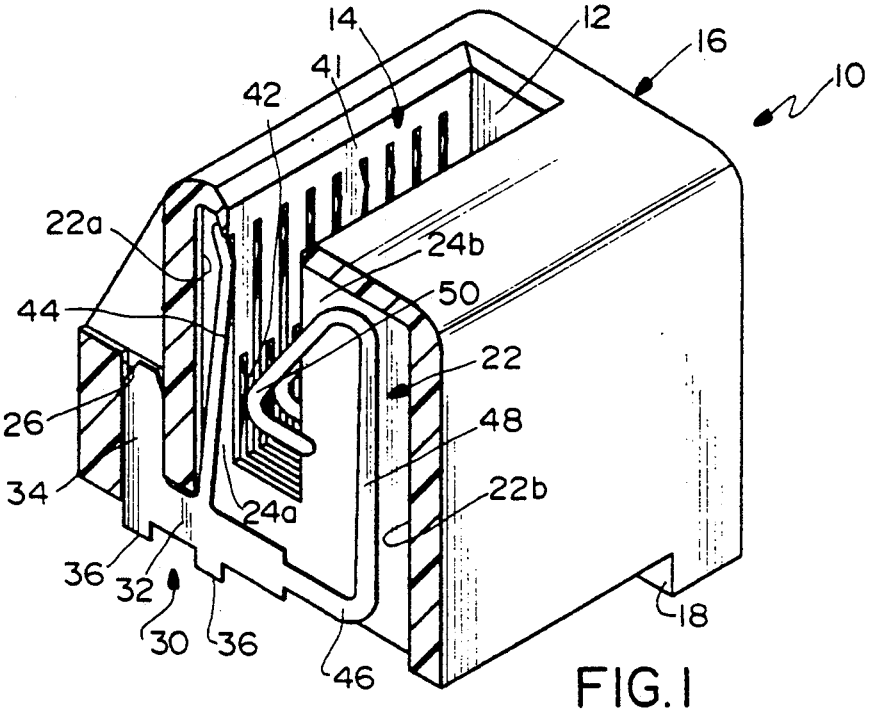
FIG. 1 is a perspective view, partly in section, of an electrical connector in which the invention is applicable.

Referring to the drawings in greater detail, and first to FIG. 1, the invention is embodied in an edge connector, generally designated 10, for a printed circuit board (not shown) having a mating edge and a plurality of contact pads adjacent the edge. These types of connectors commonly are called "edge card" connectors in that they have receptacle means in the form of a slot 12 for allowing insertion of a printed circuit board into a contact area of the connector, usually under low insertion force conditions. Such connectors normally are elongated and have rows of spring contact elements, generally designated 14 in FIG. 1, spaced along one or both sides of slot 12 lengthwise of a dielectric housing 16. The spring contact elements engage contact pads spaced along a mating edge of the printed circuit board which is inserted into the slot. It should be understood that the concepts of the invention are not limited to edge connectors of the character described, and the invention can be embodied in a wide variety of applicable electrical connectors.

With this understanding, dielectric housing 16 of edge connector 10 includes a plurality of standoffs 18 depending from the housing for engaging a surface of a second printed circuit board. Often, the second printed circuit board is called a "mother board", and the printed circuit board which is inserted into slot 12 is called a "daughter board". Dielectric housing 16 also includes a plurality of mounting or retention pegs (not shown) for locating the connector on the mother board by inserting the pegs into mounting holes in the board.

Figure 2:
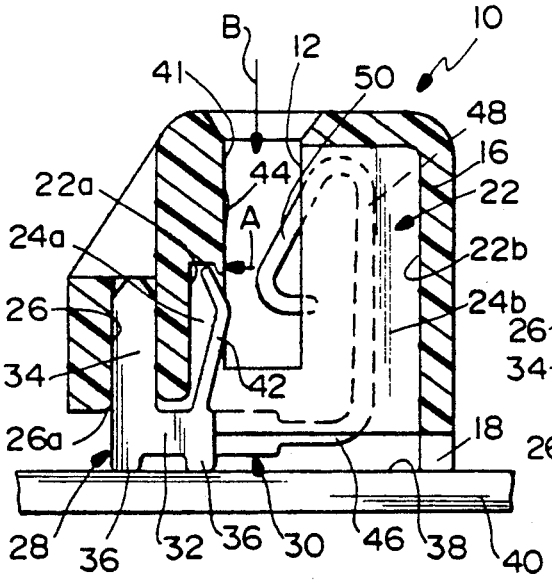
FIG. 2 is a vertical section through the elongated electrical connector of FIG. 1.
Figure 3:
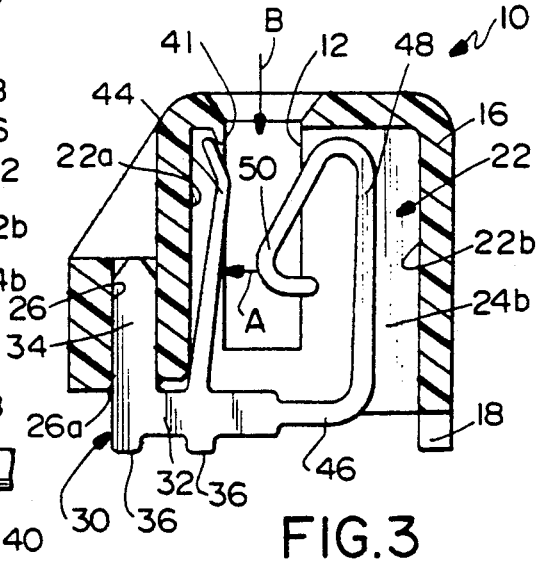
FIG. 3 is a vertical section similar to FIG. 2 but showing the long terminals.

Referring to FIGS. 1–3, housing 16 includes a plurality of transverse cavities, generally designated 22, spaced longitudinally of slot 12 for receiving alternating differently configured terminals, as described below. Specifically, each cavity 22 has a cavity portion 22*a* on one side of slot 12 (the left-hand side as viewed in FIGS. 2 and 3) and a cavity portion 22*b* on the opposite of the slot (the right-hand side as viewed in FIGS. 2 and 3). Cavities 22 are separated lengthwise of the elongated housing by wall means or partitions which include wall portions 24*a* separating cavity portions 22*a* and wall portions 24*b* separating cavity portions 22*b*.

Lastly, housing 16 includes a plurality of recesses or holes 26 outside cavities 22 and generally in transverse alignment therewith, for purposes described below. Each recess or hole 26 includes a lower mouth 26*a* opening at the bottom of housing 16. The entire housing is unitarily molded of dielectric material such as plastic or the like.

Generally, a plurality of terminals are mounted on housing 16, spaced longitudinally of the housing and corresponding to the plurality of transversely aligned cavities 22 and holes 26. Before describing the terminals in detail, it should be understood that the printed circuit board (i.e. the daughter board) which is inserted into slot 12 often has a plurality of contact pads defining two rows of pads along the edge of the board, i.e. the mating edge which is inserted into the slot. One row of contact pads is located near the absolute edge of the board, and the other row of contact pads is spaced inwardly from the one row. Therefore, conventionally, terminals are located on housing 16 with contact elements alternating lengthwise of the housing for alternatingly engaging the contact pads in the two rows thereof along the mating edge of the printed circuit board.

More particularly, terminals, generally designated 28 and 30, are mounted on housing 16 in an alternating array lengthwise of the housing. In other words, terminals 28 alternate between adjacent terminals 30. Both configurations of terminals are similar to the extent that they have base portions 32, body portions 34 projecting upwardly from the base portions and contact feet 36 projecting downwardly from the base portions. Body portions 34 are provided in the form of barbs for mounting the terminals on housing 16 by inserting the barbs through mouths 26*a* of holes 26 from the bottom of the housing. Contact feet 36 engage circuit traces on a top surface 38 of a printed circuit board 40 (the mother board). Terminals 28 have cantilevered spring contact elements 42 projecting upwardly from their respective base portions 32, and terminals 30 have cantilevered spring contact elements 44 projecting upwardly from their respective base portions. It is anticipated that terminals 28 will be utilized for the transmission of data signals at high speeds and terminals 30 will be utilized as part of ground or power circuits.

It can be seen in FIG. 2 that spring contact element 42 of terminal 28 is shorter than spring contact element 44 of terminal 30. These differentials in length enable the alternating terminals to engage the two rows of contact pads on the daughter board, as described above. It can be seen that spring contact elements 42 and 44 extend into slot 12 beyond a datum plane 41 which, in the illustrated embodiment, is the left-hand side of slot 12. Generally, biasing means are provided for biasing the mating edge of the daughter printed circuit board against datum plane 41, thereby deflecting spring contact elements 42 and 44 in the direction of arrows "A".

The stated differentials in length also enable these terminals to be selectively applied to either ground or signal functions thereby optimizing the connector performance. The shorter terminal 28 has a shorter spring contact element 42 which results in a reduced electrical path length from the point of contact of the daughter board to the mother board, which results in a reduction of the series inductance of the terminal which thus permits higher speed operation. The longer terminal 30 has a longer contact element 44 which could be used as a ground terminal which would provide substantial electrostatic isolation of interposed signal terminals.

More particularly, still referring to FIGS. 2 and 3, alternating terminals 30 have base portions which project transversely across the respective cavities 22, as indicated at 46, with a spring arm 48 projecting upwardly into cavity portion 22*b*, and with a spring element 50 projecting upwardly into slot 12 from the side of the slot opposite datum plane 41. Therefore, when the daughter printed circuit board is inserted into slot 12, in the direction of arrows "B", spring elements 50 will bias the board in the direction of arrows "A", against datum plane 41 and deflecting spring contact elements 42 and 44 a predetermined and constant amount.

In addition, spring element 50 may provide a redundant electrical contact path which could be used to further reduce contact inductance. This would typically be designated a ground terminal since one would generally not want a signal terminal to be exposed for possible capacitive coupling to other signal terminals over such a long path length.

The invention contemplates a method and structure for tuning the impedance of electrical connector 10 which is interconnected in an electrical circuit having a given impedance. With connector 10 being an edge connector, the electrical circuit would be defined by the circuitry on the printed circuit boards. As stated in the "Background", above, an ideal connector would be "transparent" in order to have as little effect on the interconnection as possible. Therefore, the invention is directed to concepts for "tuning" or varying the impedance of electrical connector 10 to match the given impedance of the interconnection system or the electrical circuit in which the connector is interconnected.

The given impedance often is called the "characteristic" impedance of a circuit and usually is known. For instance, a manufacturer of electrical connectors often is supplied by a customer with a characteristic impedance value of the circuit within which the customer is going to interconnect the particular connector. Even if this situation is not present, the impedance of any circuit can be measured by various means, such as a time domain reflectometer which utilizes an electric analog to a radar system, as well as other measuring or analyzing devices. The impedance of any particular connector similarly can be measured from input to output, again by using such instrument as a time domain reflectometer. If the impedance of the connector does not match the impedance of the interconnecting circuit, the invention contemplates a method and structure for tuning or varying the impedance of the connector in order to match the impedance of the interconnecting circuit as close as possible.

Figure 4:
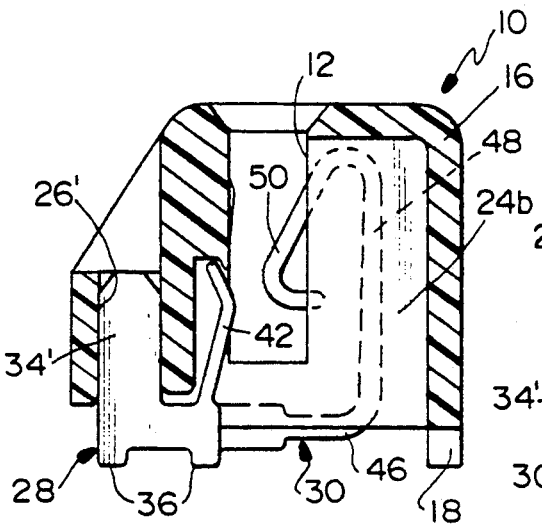
FIG. 4 is a vertical section similar to that of FIG. 2, but with the width of the barb of the terminal increased.
Figure 5:
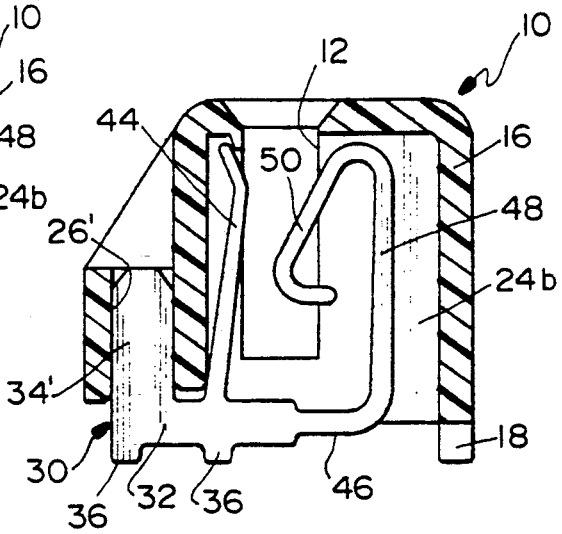
FIG. 5 is a vertical section similar to that of FIG. 3, but with the width of the barb increased.

Specifically, reference is made to FIGS. 4 and 5 wherein like reference numerals have been applied to like components described in relation to the above description of FIGS. 2 and 3. It can be seen in FIGS. 4 and 5 that body portions or barbs 34' of terminals 28 and 30 are larger in area than barbs 34 shown in FIGS. 2 and 3. Barbs 34' are mounted in enlarged recesses or holes 26' in the connector housing. Basically, in the embodiment of the invention shown in FIGS. 4 and 5, barbs 34' are of the same length but wider than barbs 34 in the embodiment illustrated in FIGS. 2 and 3. As will be described in greater detail hereinafter, by selectively varying the area of body portions or barbs 34, 34' of the terminals, the capacitance of the terminals is selectively varied and, therefore, the impedance thereof can be changed to substantially match the given impedance of the electrical circuit in which the terminals and/or connector are interconnected.

Figure 6:
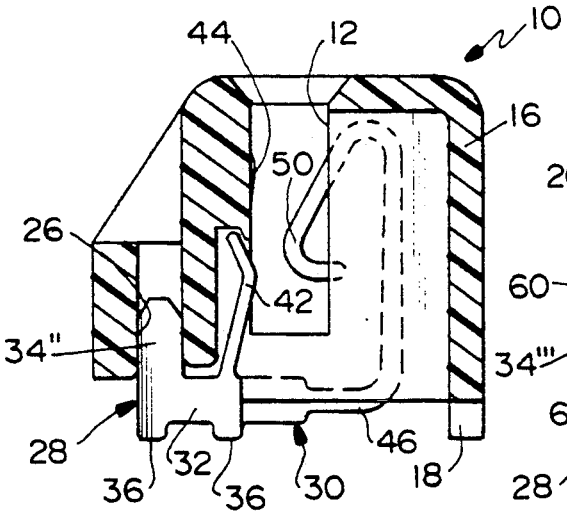
FIG. 6 is a vertical section similar to that of FIG. 2, but with the length of the barb shortened.

FIG. 6 shows another embodiment to illustrate an alternate method/structure for varying the body portions or barbs of terminals 28 and 30. Specifically, it can be seen that barb 34'' for terminal 28 in FIG. 6 is the same width as barb 34 in FIG. 1. However, barb 34'' is shorter than barb 34 and, consequently, the area thereof is varied which, in turn, varies the capacitance of the terminals and, therefore, the impedance thereof. With the embodiment of FIG. 6, housing 16 can be fabricated with constant sized recesses or holes 26 and only the configurations of terminals 28 and 30 need to be varied.

Figure 7:
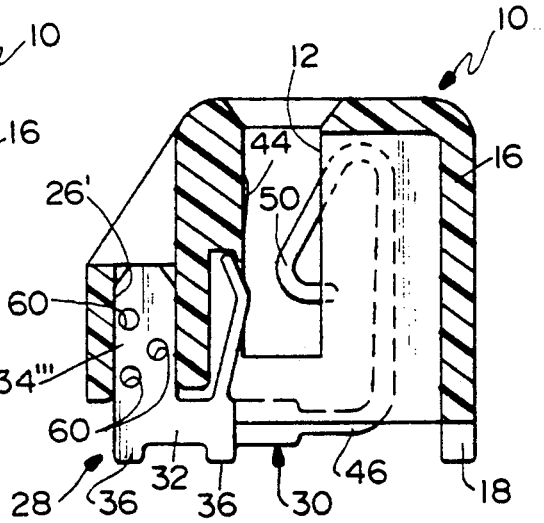
FIG. 7 is a vertical section similar to that of FIG. 4, but with the area of the barb reduced by providing openings therein.

Similarly, FIG. 7 can be compared to FIG. 4 wherein it can be seen that a barb 34''' is provided of the same length and width as barb 34' in FIG. 4. However, in the embodiment of FIG. 7, the area of body portion or barb 34''' is varied by forming openings 60 in the barb. Therefore, again, a housing can be fabricated with a constant width recess or hole 26', and only the configuration of the barb needs to be varied to tune the impedance of the electrical connector.

Figure 8:
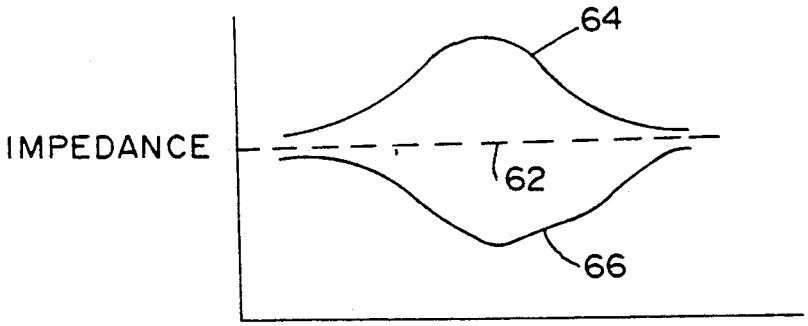
FIG. 8 is a graph showing impedance characteristics of an electrical circuit versus possible impedance characteristics of an electrical connector.

FIG. 8 graphically shows how the impedance of the electrical connectors can be tuned by varying the capacitance of the terminals. In the graph of FIG. 8, dotted line 62 represents a desired impedance of an electrical connector which, ideally, would be matched to the given impedance of the associated electrical circuit. Line 64 represents an impedance which is, as shown, higher than the desired or given impedance. In order to reduce the impedance (i.e. lowering line 64), capacitance is added. According to the concepts of the invention, the effective areas of the body portions 34, 34', 34'', 34''' would be increased to increase the capacitance and, thereby, lower the impedance, preferably to the desired or given impedance represented by line 62. It should be understood that lines 64 and 66 represent purely schematic illustrations of average or lumped constant impedance values, solely for illustration purposes. In fact, if the graph were plotted from actual measurements, the lines would typically not be smooth but rather "jagged".

Conversely, line 66 represents a condition wherein the impedance is too low. Under these conditions, the capacitance should be reduced in order to increase the impedance to approach the desired or given impedance represented by line 62. Again, according to the concepts of the invention, this variance or "tuning" can be accomplished by reducing the effective area of the body portions of the terminals.

The invention also contemplates a novel structure for reducing the inductance of an electrical connector, such as the edge connectors shown in FIGS. 1–7. In connector 10, terminals 28 and 30 may comprise alternating signal terminals, but some of the terminals may comprise ground terminals. In fact, all of the "long" terminals 30 could comprise ground terminals. It is desirable to reduce the inductance of any connector, but, for the following description, it is assumed that terminals 30 are terminals which are coupled to ground traces on printed circuit board 40 and their spring elements 50 engage ground contact pads on the edge of the daughter board. The individual ground traces on board 40 all are part of a common ground circuit, as is found in many edge connectors. Therefore, it would be desirable to reduce the inductance through these ground terminals to the common ground circuit.

More particularly, referring back to FIG. 2 (along with FIGS. 3–7) it can be seen that terminals 28 and 30, and particularly ground terminals 30, have at least two feet 36, as described above, for engaging a single circuit trace on top surface 38 of printed circuit board 40. At this point, it should be noted that, although feet 36 are illustrated for surface mounting to a circuit trace on the printed circuit board, at least one of the feet could comprise a solder tail or pin for insertion into a hole in the printed circuit board, with the solder tail being electrically connected to the circuit trace on the board or within a plated-through hole in the board.

By providing two feet 36 for a single terminal, it is contemplated that both feet be electrically coupled to a single circuit trace on the board. Such a construction provides a larger contact surface with the circuit trace. The larger contact surface reduces the voltage drop and the increase in cross-sectional area reduces the inductance between a respective terminal and a single circuit trace on the printed circuit board. Such a structure is particularly useful in high speed connectors. In the case of one of the ground terminals, both grounding feet would engage a respective one of a plurality of ground circuit traces on the printed circuit board, the circuit traces being part of a common ground circuit. By spacing the feet apart from each other, an area of the board, between the feet, is left open to facilitate routing various other circuit traces on the board.

In addition, the larger contact area also provides an advantage when utilized with signal terminals in high speed applications. Such increased contact area reduces the series inductance which thus improves high speed performance.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A method of tuning the impedance of an electrical connector adapted for interconnection in a plurality of electrical circuits, each having a given impedance, without requiring the modification of a footprint of the connector relative to a complementary mating electrical component, said method comprising the steps of:

providing a set of dielectric electrical connector housings for mounting a plurality of terminals therein, all of the housings including a substantially identical receptacle for receiving a complementary mating electrical component, a plurality of terminal receiving cavities positioned adjacent said receptacle and adapted for receiving a portion of a terminal therein, and a plurality of anchoring regions, each anchoring region being adapted to receive an anchoring portion of a terminal therein to operatively secure said terminal in said housing, each of said housings including anchoring regions different from the anchoring regions of the other of said housings for receiving differently configured anchoring portions of the terminals;

providing sets of conductive terminals for selective mounting in the set of housings, all of the terminals having a connection interface section for mating with electrical components of a complementary mating electrical component, a tail portion for interconnecting said terminal to its respective electrical circuit and an anchoring portion separate from said connection interface section, said connection interface sections being substantially identical and including a contact arm and a contact portion located thereon, each set of terminals having generally planar anchoring portions of a different surface area than the anchoring portions of the other sets of terminals in order to vary the impedance characteristics of each set of terminals;

selecting a set of said terminals having a desired predetermined impedance substantially similar to said given impedance in order to select the impedance of the terminals without varying the dimensions of said connection interface sections;

selecting one of said housings having anchoring regions dimensioned for operatively receiving the anchoring portions of said selected set of terminals thereat; and inserting said selected set of terminals into said housing;

whereby the impedance of the terminals may be selected without requiring a modification to the footprint of the connector relative to a complementary mating electrical component.

2. The method of claim 1 wherein the generally planar anchoring portions of at least one of said sets of terminals have openings therein to reduce the surface area of the anchoring portions.

3. The method of claim 1 wherein the generally planar anchoring portions of some of the sets of terminals have a generally identical width and the terminals of each of said some of the sets have different height in the direction of insertion into the housing, whereby the terminals of said some of the sets are insertable into the same housing.

4. The method of claim 3 wherein said contact arm and said anchoring portion each extend in a cantilevered manner from a base portion and are spaced apart thereon.

5. The method of claim 4 wherein said anchoring portions are barbs that are press fit into cavities in said anchoring region.

6. A method of tuning the impedance of an electrical connector adapted for interconnection in a plurality of electrical circuits, each circuit having a given impedance, said method comprising the steps of:

(a) providing a dielectric electrical connector housing for mounting a plurality of terminals therein, said housing including a receptacle for receiving a complementary mating electrical component, a plurality of terminal receiving cavities adjacent said receptacle adapted for receiving a portion of a terminal therein, and a plurality of anchoring regions adapted to receive an anchoring portion of a terminal therein to operatively secure said terminal in said housing;

(b) providing sets of conductive terminals for selective mounting in the housing, all of the terminals having a connection interface section, a tail portion for interconnecting said terminal to one of said electrical circuits and a body section distinct from said connection interface section and having an anchoring portion thereon to retain said terminal to said housing, said connection interface sections being substantially identical including a compliant contact portion for contacting a respective electrical component of said complementary mating electrical component, each set of terminals including generally planar body sections having a different surface area than the body sections of the terminals of the other sets of terminals in order to vary the impedance characteristics of each set of terminals;

(c) selecting a terminal from one of said sets of terminals in order to select a terminal having a desired predetermined impedance substantially similar to the given impedance of a particular electrical circuit without varying the dimensions of said connection interface sections;

(d) inserting said selected terminal into said housing; and (e) repeating steps (c) and (d) until terminals are inserted into all of the terminal receiving cavities of the housing.

7. The method of claim 6 wherein the generally planar body sections of said sets of terminals have a generally identical width and the body sections of the terminals of each set have a different height in the direction of insertion into the housing.

8. The method of claim 6 wherein the generally planar body sections of at least one of said sets of terminals have openings therein to reduce the surface area of body sections.

9. The method of claim 6 wherein said contact arm and said anchoring portion each extend in a cantilevered manner from a base portion and are spaced apart thereon.

10. The method of claim 9 wherein said anchoring portions are barbs that are press fit into cavities in said anchoring region.

11. A method of tuning the impedance of an electrical connector adapted for interconnection in a plurality of electrical circuits, each circuit having a given impedance, said method comprising the steps of:

(a) providing a dielectric electrical connector housing for mounting a plurality of terminals therein, said housing including a slot for receiving an elongate complementary mating electrical component, a plurality of terminal receiving cavities adjacent said slot adapted for receiving a portion of a terminal therein, and a plurality of anchoring regions adapted to receive an anchoring portion of a terminal therein to operatively secure said terminal in said housing;

(b) providing sets of conductive first terminals for selective mounting in the housing, each of the first terminals having a connection interface section, a tail portion for interconnecting said first terminal to one of said electrical circuits and a body section distinct from said connection interface section and including an anchoring portion thereon to secure said first terminal to said housing, said connection interface section of said first terminals being substantially identical and including a first resilient contact member extending from a base and having a first contact portion on said first contact member for contacting a respective electrical component of said complementary mating electrical component, the terminals of each set of first terminals having generally planar body sections and with each having a different surface area than the body sections of the other sets of first terminals in order to vary the impedance characteristics of each set of first terminals;

(c) providing sets of conductive second terminals for selective mounting in the housing, each of the second terminals having a connection interface section, a tail portion for interconnecting said second terminal to one of said electrical circuits and a body section distinct from said connection interface section and including an anchoring portion to secure said second terminal to said housing, said connection interface section of said second terminals being substantially identical and including a second resilient contact member extending from a base and having a second contact portion on said second contact member for contacting a respective electrical component of said complementary mating electrical component, said connection interface section of the second terminal being different than that of the first terminal, the terminals of each set of second terminals having generally planar body sections and with each having a different surface area than the body sections of the other sets of second terminals in order to vary the impedance characteristics of each set of second terminals;

(d) selecting a terminal from one of said sets of terminals in order to select a terminal having a desired predetermined impedance substantially similar to the given impedance of a particular circuit as well as a desired predetermined connection interface section; and (e) inserting said selected terminal into said housing;

(f) repeating steps (d) and (e) until terminals are inserted into all of the terminal receiving cavities of the housing.

12. The method of claim 11 wherein the generally planar body sections of said sets of first terminals have a generally identical width and the body sections of each set of first terminals have a different height in the direction of insertion into the housing and the generally planar body sections of said sets of second terminals have a generally identical width and the body sections of each set of second terminals have a different height in the direction of insertion into the housing.

13. The method of claim 11 wherein the generally planar body sections of at least one of said sets of terminals have openings therein to reduce the surface area of body sections.

14. The method of claim 11 wherein said contact arm and said anchoring portion each extend in a cantilevered manner from a base portion and are spaced apart thereon.

15. The method of claim 14 wherein said anchoring portions are barbs that are press fit into cavities in said anchoring region.

* * * * *